US005807166A

United States Patent [19]

Bando

[11] Patent Number: 5,807,166

[45] Date of Patent: Sep. 15, 1998

[54] GLASS-PLATE WORKING MACHINE

[75] Inventor: Shigeru Bando, Tokushima, Japan

[73] Assignee: Bando Kiko Co., Ltd., Tokushima, Japan

[21] Appl. No.: 663,865

[22] Filed: Jun. 19, 1996

Related U.S. Application Data

[63] Continuation of Ser. No. 256,741, filed as PCT/JP92/01664, Dec. 18, 1992, published as WO94/14570, Jul. 7, 1994, abandoned.

[51] Int. Cl.[6] ..... B24B 1/00

[52] U.S. Cl. ..... 451/43; 451/242; 451/41

[58] Field of Search ..... 451/14, 41, 43, 451/44, 146, 242, 5, 9, 10, 11, 254, 255, 256, 258, 177

[56] References Cited

U.S. PATENT DOCUMENTS

| | | | |
|---|---|---|---|
| 2,782,569 | 2/1957 | Robbins | 451/44 |
| 4,375,738 | 3/1983 | Bando | 451/44 |
| 4,769,954 | 9/1988 | Hatas et al. . | |
| 5,040,342 | 8/1991 | McGuire et al. | 451/44 |
| 5,079,876 | 1/1992 | Zumstein | 451/44 |
| 5,099,617 | 3/1992 | Bovone | 451/44 |
| 5,146,715 | 9/1992 | Bando | 451/44 |
| 5,265,382 | 11/1993 | Park | 451/44 |
| 5,327,686 | 7/1994 | Park | 451/44 |
| 5,409,417 | 4/1995 | Bando | 451/242 |

FOREIGN PATENT DOCUMENTS

| | | |
|---|---|---|
| 0 168 311 | 1/1986 | European Pat. Off. . |
| 46-18558 | 5/1971 | Japan . |
| 54-117991 | 9/1979 | Japan . |
| 55-25024 | 7/1980 | Japan . |
| 56-114655 | 9/1981 | Japan . |
| 60-12187 | 3/1985 | Japan . |
| 2-100841 | 4/1990 | Japan . |
| 3-170260 | 7/1991 | Japan . |

*Primary Examiner*—Timothy V. Eley
*Assistant Examiner*—Derris H. Banks
*Attorney, Agent, or Firm*—Nixon & Vanderhye

[57] ABSTRACT

A glass-plate working machine 1 includes a table 3 on which a glass plate 2 is placed; a grinding wheel 4 for providing working to the glass plate 2; an electric motor 6 for driving the grinding wheel 4; a positioning device 8 for positioning a working portion C of the grinding wheel 4 with respect to a working point A on the glass plate 2; a fixing device 10 for fixing the glass plate 2 onto the table 3; and a revolving device 16 for revolving the grinding wheel 4 so as to dispose a center 14 of rotation of the grinding wheel 4 in a direction C normal to a contour 13. The positioning device 8 includes a moving device 18 for moving the grinding wheel 4 in a direction X and a rotating device 20 for rotating the table 3.

8 Claims, 5 Drawing Sheets

GLASS-PLATE WORKING MACHINE

This is a continuation of application Ser. No. 08/256,741, filed as PCT/JP92/01664 Dec. 18, 1992 published as WO94/14570 Jul. 7, 1994, now abandoned.

TECHNICAL FIELD

The present invention relates to a glass-plate working machine.

BACKGROUND ART

In conventional glass-plate working machines, a working portion of a working tool is positioned at a working point on a glass plate to be worked by linearly moving the working tool in two directions perpendicular to each other within a plane, or the working portion of the working tool is relatively positioned with respect to a working point on the glass plate to be worked by moving the working tool in a linear direction within a plane while moving the glass plate to be worked in another linear direction perpendicular to the direction of movement of the working tool within the plane. Subsequently, for instance, all the peripheral edges of the glass plate are subjected to edging, chamfering, grinding and/or polishing, or the like.

With the above-described conventional glass-plate working machines, unless the machine is formed in such a manner as to be capable of moving the working tool from one position on a peripheral edge of the glass plate to another position on an opposite peripheral edge opposing that edge position, it is impossible to effect, for instance, chamfering with respect to all the peripheral edges of the glass plate. For this reason, it is difficult to provide, for example, a fixedly disposed glass-plate fixing device in an area where the working tool moves. With the conventional glass-plate working machine of this type, a sucking-disc device is provided on the table where the glass plate is placed, and the glass plate is sucked by this sucking-disc device to fix the glass plate from the table side. Chamfering, for instance, is provided for the glass plate which is thus fixed on one side thereof only. However, if the glass plate is fixed on one side, it is difficult to fix the glass plate securely and reliably, and if an attempt is made to press the working tool against a peripheral edge of the glass plate to cut the edge of the glass plate for the purpose of chamfering, for example, there is the risk of the glass plate from becoming offset from its proper position. In addition, with the conventional glass-plate working machines, it is difficult to effect a machining operation by providing a plurality of working tools and allocating working areas to the respective working tools to reduce the machining time, thereby making it impossible to obtain a large volume of worked glass plates in a short time.

In addition, in a glass-plate working machine which is further provided with a revolving device for revolving a grinding wheel for chamfering, i.e., a working tool, with the center of rotation of the grinding wheel being disposed in a direction normal to a contour to which the glass plate is to be machined at a working point, in a case where the grinding wheel is revolved by the revolving device to chamfer the entire periphery of the glass plate, there are cases where, for instance, the wiring to an electric motor for rotating the grinding wheel, or a flexible pipe for supplying an abrasive solution, is unnecessarily twisted and is coiled around the electric motor or a bracket for supporting the same. Hence, there is a drawback in that this twisting and coiling must be undone and their original states must be resumed when the operation proceeds to an ensuing step.

The present invention has been devised in view of the above-described aspects, and its object is to provide a glass-plate working machine which is capable of securely fixing the glass plate to be worked and of thereby providing accurate machining to the glass plate, and which makes it possible to allow a working tool to be pressed substantially firmly against the glass plate, thereby making it possible to effect a large volume of grinding at a time.

Another object of the present invention is to provide a glass-plate working machine which makes it possible to substantially eliminate the occurrence of the coiling, twisting and the like of the wiring to a driving device for driving a working tool or an abrasive-solution supplying pipe.

Still another object of the present invention is to provide a glass-plate working machine which makes it possible to effect a machining operation by providing a plurality of working tools and allocating working areas to the respective working tools, thereby making it possible to reduce the machining time.

DISCLOSURE OF THE INVENTION

In accordance with the present invention, the above objects are attained by a glass-plate working machine comprising a table on which a glass plate to be worked is placed, a working tool for working the glass plate placed on the table, a driving device for driving the working tool, a positioning device for relatively positioning a working portion of the working tool with respect to a working point on the glass plate, and a fixing device for fixing the glass plate onto the table, wherein the positioning device includes a linearly moving device for moving the working tool in a linear direction so as to position the working portion of the working tool with respect to the working point on the glass plate concerning the linear direction within a plane, and a rotating device for rotating the glass plate so as to position the working point on the glass plate with respect to the working portion of the working tool concerning a direction of rotation within the plane.

In addition, the above objects are attained by a glass-plate working machine comprising a table on which a glass plate to be worked is placed, a plurality of working tools for working the glass plate placed on the table, within a plane at different positions around the table, a driving device for driving the working tools, a positioning device for relatively positioning working portions of the working tools with respect to working points on the glass plate, and a fixing device for fixing the glass plate onto the table, wherein the positioning device includes a plurality of linearly moving devices for respectively moving the working tools in linear directions so as to position the working portions of the working tools with respect to the working points on the glass plate concerning the linear directions within the plane, and a rotating device for rotating the glass plate so as to position the working points on the glass plate with respect to the working portions of the working tools concerning a direction of rotation within the plane.

In a preferred example of the present invention, the working tool is a grinding wheel, and the glass-plate working machine further comprises a revolving device for revolving the grinding wheel around an axis perpendicular to the plane and passing through the working point, so as to dispose a center of rotation of the grinding wheel in a direction normal to a contour to which the glass plate is to be machined at the working point.

The fixing device in accordance with the present invention is embodied by incorporating a sucking-disc device in the table itself. In another preferred example, the fixing device includes a pressing device for pressing and clamping the glass plate in cooperation with the table. This pressing device preferably comprises an air cylinder which is capable of pressing the glass plate with the resiliency of air.

In the glass-plate working machine of the present invention thus constructed, the glass plate to be worked is placed on the table, and this placed glass plate is fixed onto the table by the fixing device. The working is carried out on the glass plate fixed on the table by the working tool which is driven by the driving device. In this working, the working tool is linearly moved in a linear direction within a plane by the linearly moving device, and the working portion is positioned with respect to the working point on the glass plate concerning the linear direction within the plane. The glass plate is rotated by the rotating device, and the working point thereon is positioned at the working portion of the working tool concerning the direction of rotation within the plane. Consequently, the working portion of the working tool is relatively positioned consecutively with respect to working points on the glass plate.

As described above, in the glass-plate working machine of the present invention, the positioning device is provided with a linearly moving device for moving the working tool in a linear direction so as to position the working portion of the working tool with respect to the working point on the glass plate concerning the linear direction within a plane, and a rotating device for rotating the glass plate so as to position the working point on the glass plate with respect to the working portion of the working tool concerning a direction of rotation within the plane. Accordingly, it is possible to substantially eliminate the occurrence of the coiling, twisting and the like of such as the wiring to the driving device for driving the working tool, and the operating efficiency improves remarkably. In addition, it is possible to securely fix the glass plate to be worked and to thereby provide accurate machining to the glass plate, and it is possible to allow the working tool to be pressed substantially firmly against the glass plate, thereby making it possible to effect a large volume of grinding at a time. Moreover, it is possible to effect a machining operation by providing a plurality of working tools and allocating working areas to the respective working tools, thereby making it possible to reduce the machining time.

Hereafter, a description will be given of preferred embodiments of the present invention which are illustrated in the drawings, and the above and other aspects of the present invention will become more apparent therefrom. It should be noted that the present invention is not limited to these preferred embodiments.

EMBODIMENTS

Figure 1:
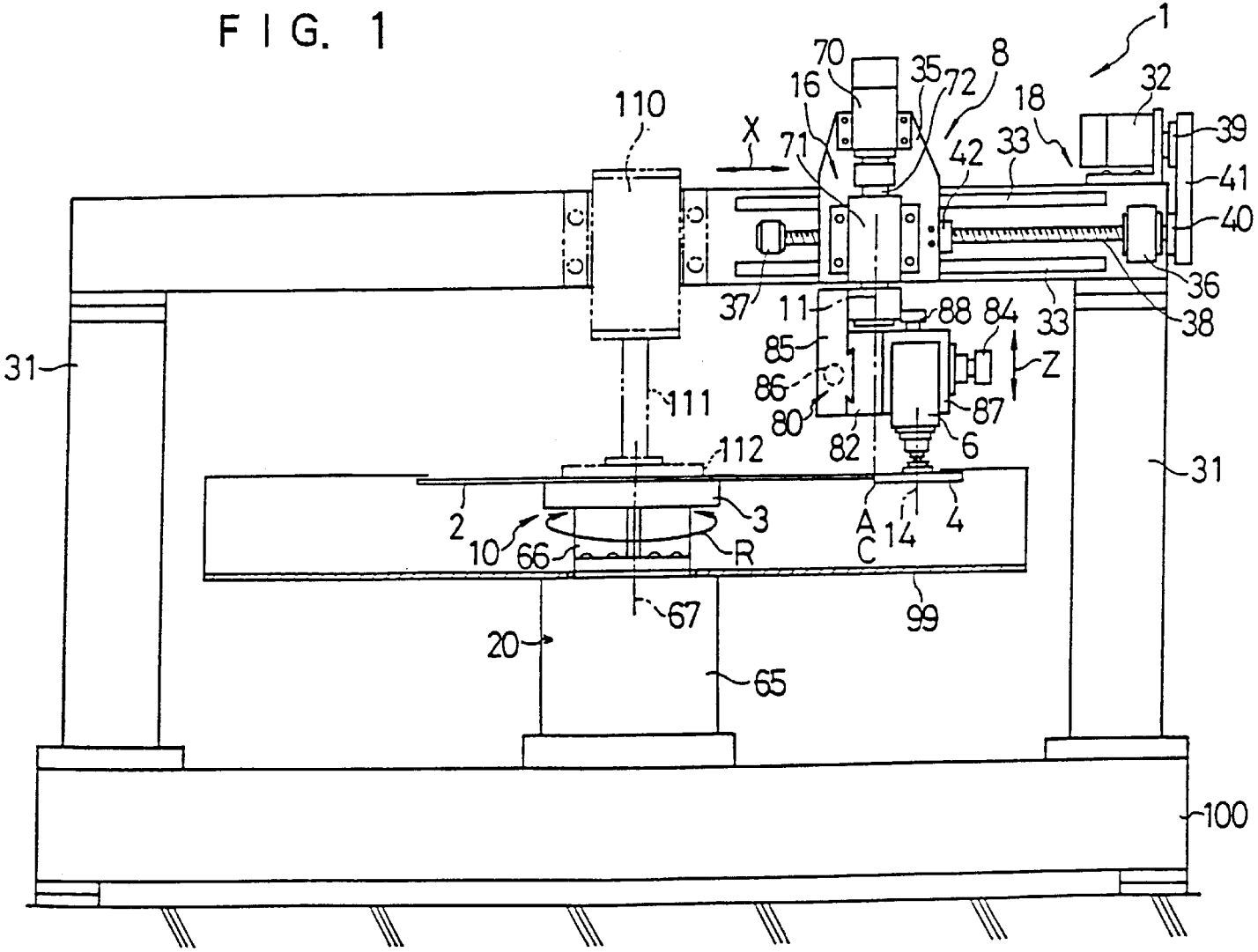
FIG. 1 is a front elevational view of a preferred embodiment of the present invention.
Figure 2:
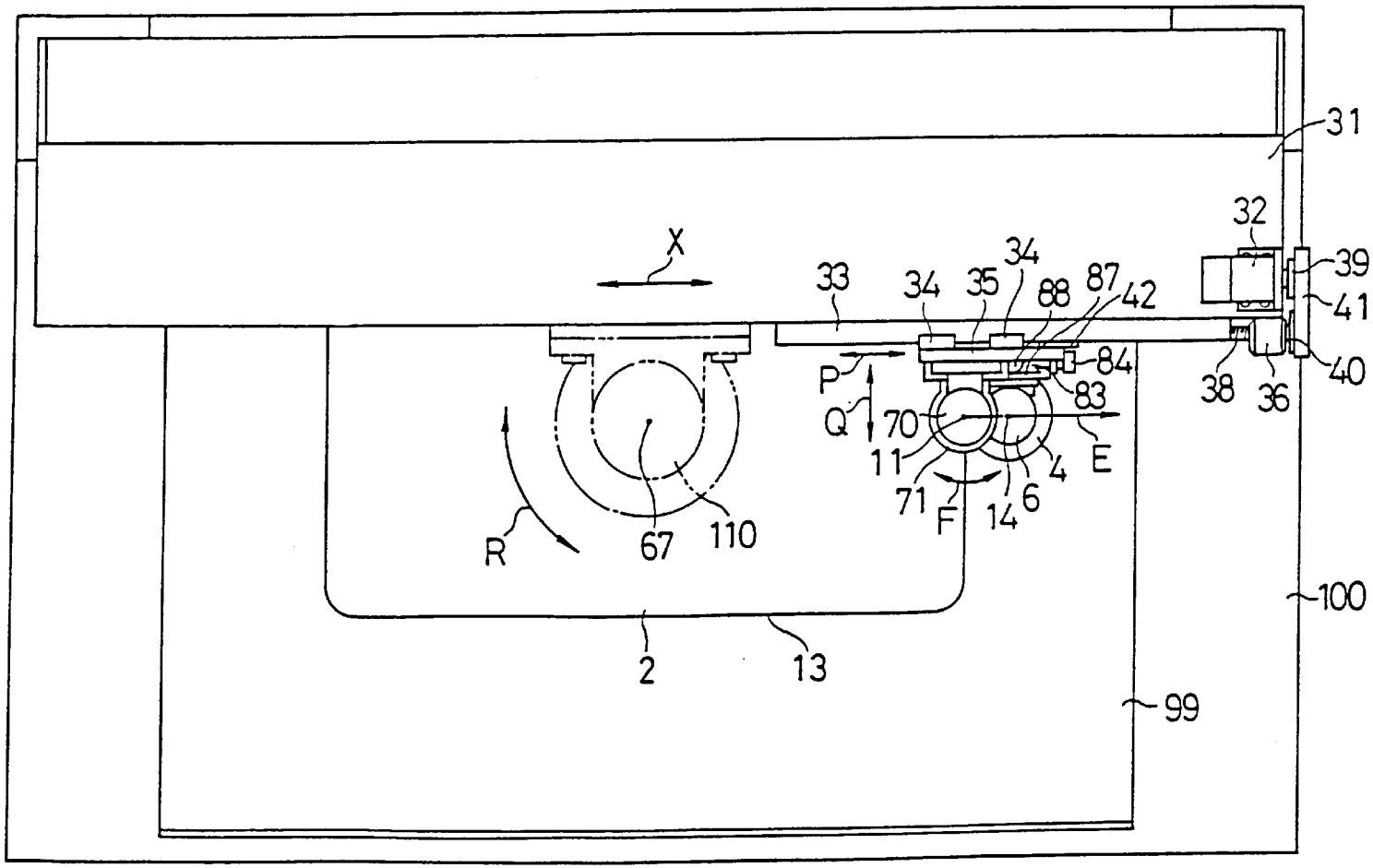
FIG. 2 is a plan view of the embodiment shown in FIG. 1.
Figure 3:
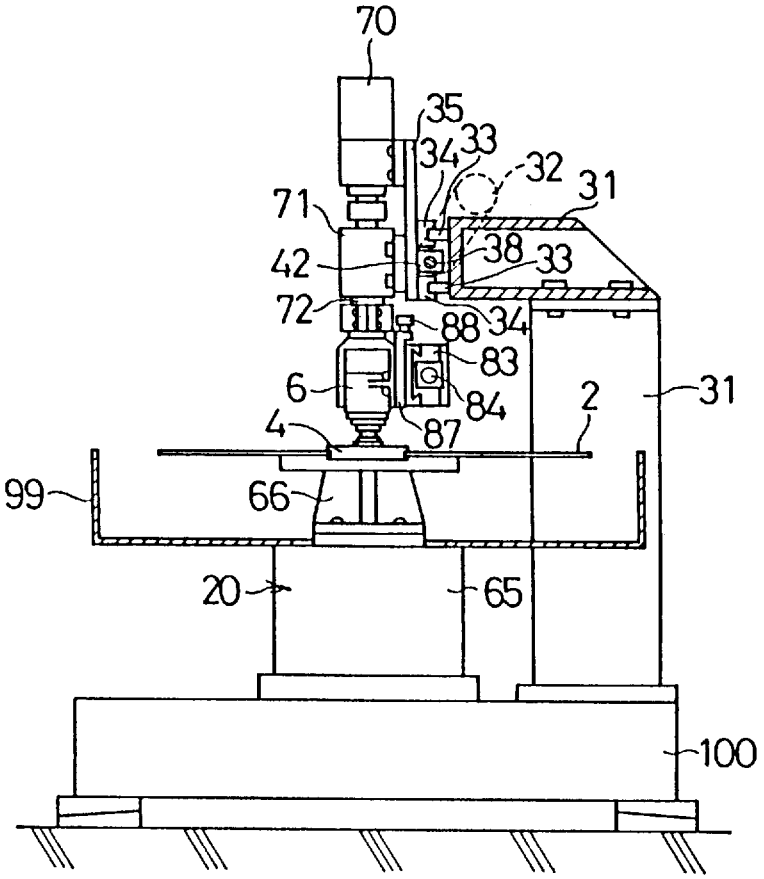
FIG. 3 is a side elevational view of the embodiment shown in FIG. 1.

In FIGS. 1 to 3, a glass-plate working machine 1 in accordance with this embodiment comprises a table 3 on which a glass plate 2 to be worked is placed; a grinding wheel 4 which is a working tool for providing working at a position around the table 3 in a plane, i.e., in a horizontal plane in this embodiment; an electric motor 6 which is a driving device for driving the grinding wheel 4; a positioning device 8 for relatively positioning a working portion C of the grinding wheel 4 with respect to a working point A on the glass plate 2; a fixing device 10 for fixing the glass plate 2 onto the table 3; and a revolving device 16 for revolving the grinding wheel 4 around an axis 11 perpendicular to the horizontal plane and passing through the working point A, so as to dispose a center 14 of rotation of the grinding wheel 4 in a direction normal to a contour 13 to which the glass plate 2 is to be machined at the working point A, i.e., in a direction E. The positioning device 8 includes a linearly moving device 18 for moving the grinding wheel 4 in a direction X so as to position the working portion C of the grinding wheel 4 with respect to the working point A on the glass plate 2 concerning the direction X which is a linear direction within the horizontal plane, as well as a rotating device 20 for rotating the glass plate 2 by means of the table 3 so as to position the working point A on the glass plate 2 with respect to the working portion C of the grinding wheel 4 concerning the direction of rotation within the horizontal plane, i.e., a direction R.

In the positioning device 8 for relatively positioning the working portion C of the grinding wheel 4 with respect to the working point A on the glass plate 2, the linearly moving device 18 for moving the grinding wheel 4 in the direction X within the horizontal plane so as to position the working portion C of the grinding wheel 4 with respect to the working point A on the glass plate 2 concerning the direction X within the horizontal plane is comprised of an electric motor 32 mounted on a machine frame 31; a pair of rails 33 attached to the machine frame 31 in such a manner as to extend in the direction X and in parallel with each other; a movable base 35 attached to the rails 33 movably in the direction X by means of sliders 34; and a threaded shaft 38 supported rotatably by the machine frame 31 by means of bearings 36 and 37. A belt 41 is trained between a pulley 39 attached to an output rotating shaft of the motor 32 and a pulley 40 attached to one end of the threaded shaft 38, and the threaded shaft 38 is threadedly engaged with a nut 42 attached to the movable base 35. When the motor 32 is activated and its output rotating shaft is thereby rotated, its rotation is imparted to the threaded shaft 38 by means of the pulley 39, the belt 41, and the pulley 40, and the rotation of the threaded shaft 38 meshing with the nut 42 moves the movable base 35 in the direction X.

The rotating device 20 is constituted by an electric motor 65, and an output rotating shaft 66 of the motor 65 is connected to the table 3. When the motor 65 is activated and its output rotating shaft 66 is thereby rotated, the table 3 and, hence, the glass plate 2 are rotated about an axis 67 in the direction R.

The revolving device 16 for revolving the grinding wheel 4 around the axis 11 perpendicular to the horizontal plane and passing through the working point A, so as to dispose the center 14 of rotation of the grinding wheel 4 in the direction E with respect to the contour 13 to which the glass plate 2 is to be machined at the working point A, comprises an electric motor 70 attached to the movable base 35, and a rotating shaft 72 connected to an output rotating shaft of the motor 70 and attached to the movable base 35 by means of a bearing 71 in such a manner as to be rotatable about the axis 11 in a direction F. When the motor 70 is activated and its output shaft is thereby rotated, the rotating shaft 72 is also rotated about the axis 11, thereby causing the grinding wheel 4 to be revolved about the shaft 11 in the direction F within the horizontal plane.

In the glass-plate working machine 1 in accordance with this embodiment, the motor 6 is connected to the rotating shaft 72 via an adjustment mechanism 80 for adjusting the position of the working portion C of the grinding wheel 4 concerning a direction P within the horizontal plane, a direction Q perpendicular to this direction P, and a vertical direction perpendicular to the horizontal plane, i.e., a direction Z. The adjustment mechanism 80 is comprised of a P-direction adjusting mechanism including a slider 83 attached to a slider 82 in such a manner as to be movable in the direction P relative to the slider 82, and an adjustment knob 84 for adjusting the P-direction position of the slider 83 with respect to the slider 82; a Q-direction adjusting mechanism including the slider 82 attached to a bracket 85 in such a manner as to be movable in the direction Q relative to the bracket 85 connected and secured to the rotating shaft 72, and an adjustment knob 86 for adjusting the Q-direction position of the slider 82 with respect to the bracket 85; and a Z-direction adjusting mechanism including a slider 87 with the motor 6 attached thereto, the slider 87 being attached to the slider 83 in such a manner as to be movable in the direction Z relative to the slider 83, and an adjustment knob 88 for adjusting the Z-direction position of the slider 87 with respect to the slider 83. As each of the knobs 84, 86, and 88 is rotated, it is possible to adjust the P-direction position of the slider 83 with respect to the slider 82, the Q-direction position of the slider 82 with respect to the bracket 85, and the Z-direction position of the slider 87 with respect to the slider 83, respectively.

The fixing device 10 is constituted by a vacuum sucking-disc device incorporated in the table 3, and the sucking-disc device sucks the glass plate 2 placed on the table 3 under a vacuum, and fixes the same onto the table 3.

It should be noted that, in the glass-plate working machine 1, an unillustrated flexible abrasive supplying pipe having one end disposed in proximity to the working portion C is attached to the bracket 85 so as to supply the abrasive solution to the working portion C. This abrasive supplying pipe receives the supply of the abrasive solution from an unillustrated supply pump, and supplies the abrasive solution to the working portion C during the machining of the glass plate 2. In addition, in the glass-plate working machine 1 in this embodiment, an abrasive solution sump 99 for preventing the scattering of the abrasive solution to outside the apparatus is disposed by being supported by an outer case of the motor 65. The motor 65 and the machine frame 31 are respectively mounted on a base 100.

The motors 6, 32, 65, and 70 of the glass-plate working machine 1 thus arranged are operated by preprogrammed numerical control commands of an unillustrated numerical control unit.

The glass-plate working machine 1 performs a chamfering operation with respect to the glass plate 2 as follows. First, the knobs 84, 86, and 88 are rotated to move the grinding wheel 4 in the directions P, Q, and Z so as to allow a peripheral edge of the grinding wheel 4 to be brought into contact with the peripheral edge 13 of the glass plate 2. It should be noted an initial setting is provided by rotating the bracket 85 about the axis 11 such that the position of contact between the grinding wheel 4 and the glass plate 2, i.e., the working point A which is also located at the working portion C, is located on the axis 11, and that the center 14 of rotation of the grinding wheel 4 is located in a direction normal to the tangent of the peripheral edge 13 to be ground of the glass plate 2 at the working point A, i.e., in the normal direction (direction E) at the working point A. In such a state of initial setting, the direction P and the direction E are set in the same direction, so that the rotation of the knob 84 adjusts the amount of cut in grinding the glass plate 2.

Next, as the numeral control unit is operated, the motors 6, 32, 65, and 70 are activated by being controlled by the same, so that the working portion C of the grinding wheel 4 is positioned along the peripheral edge 13 to be ground of the glass plate 2 by the movement of the movable base 35 in the direction X and the rotation of the glass plate 2 in the direction R. At the same time, as the grinding wheel 4 itself rotates, the glass plate 2 is subjected to chamfering at the working point A. During chamfering, the bracket 85 is revolved about the axis 11 in the direction F by the activation of the motor 70 such that the center 14 of rotation of the grinding wheel 4 is located in the direction normal to the peripheral edge 13 to be chamfered of the glass plate 2 at the working point A, i.e., in the direction E.

In the glass-plate working machine 1 in this embodiment, since the glass plate 2 is rotated in the direction R to allow the working point A where chamfering is to be effected to be positioned with respect to the grinding wheel 4, the revolution of the grinding wheel 4 and, hence, the motor 6 about the axis 11 in the direction F is not effected by exceeding 360 degrees, and is in many cases effected within 180 degrees. Accordingly, the wiring to the motor 6, the abrasive supplying pipe and the like are prevented from becoming entangled with or coiled around the bracket 85 and the like. Consequently, when chamfering is effected with respect to another glass plate upon completion of the chamfering of one glass plate, it is possible to set upon the operation immediately without requiring an operation for reversely rotating the bracket 85 in order to restore the original states of the wiring to the motor 6, the abrasive supplying pipe and the like which are otherwise entangled with or coiled around the bracket 85 and the like.

Although the fixing device 10 of the glass-plate working machine 1 in the above-described embodiment is embodied by the sucking-disc device incorporated in the table 3, an arrangement may be provided such that, for instance, an air cylinder device 110 serving as a pressing device is attached to the machine frame 31, and the glass plate 2 is pressed and clamped with the resiliency of air by the table 3 and a pressing pad 112 provided at a distal end of a piston rod 111 of the air cylinder device 110 in such a manner as to be rotatable in the direction R, thereby fixing the glass plate 2 onto the table 3.

Thus, in the glass-plate working machine 1, since the fixing device for pressing and clamping the glass plate 2 in cooperation with the table 3 can be disposed, the glass plate 2 can be fixed securely during machining, with the result that the glass plate 2 can be provided with accurate machining. At the same time, the grinding wheel 4 can be pressed against the glass plate 2 with a substantially strong force, so that a large volume of grinding can be effected at a time.

In addition, the working machine in accordance with the present invention is not limited to the chamfering use, and may be used in other glass-plate working processes including polishing, cutting, and splitting, in which cases it suffices if working tools suited to them are used.

Figure 4:
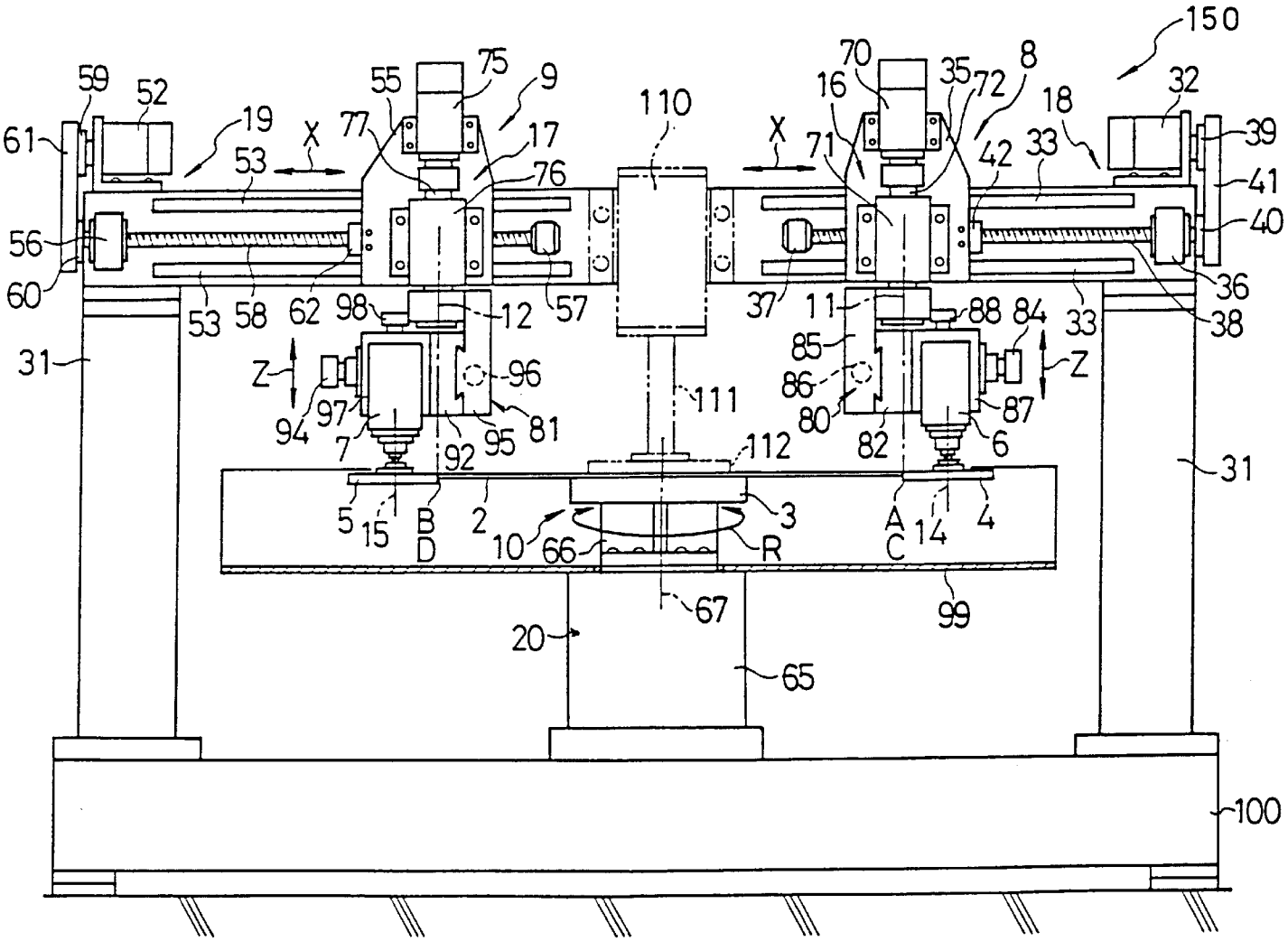
FIG. 4 is a front elevational view of another preferred embodiment of the present invention.
Figure 5:
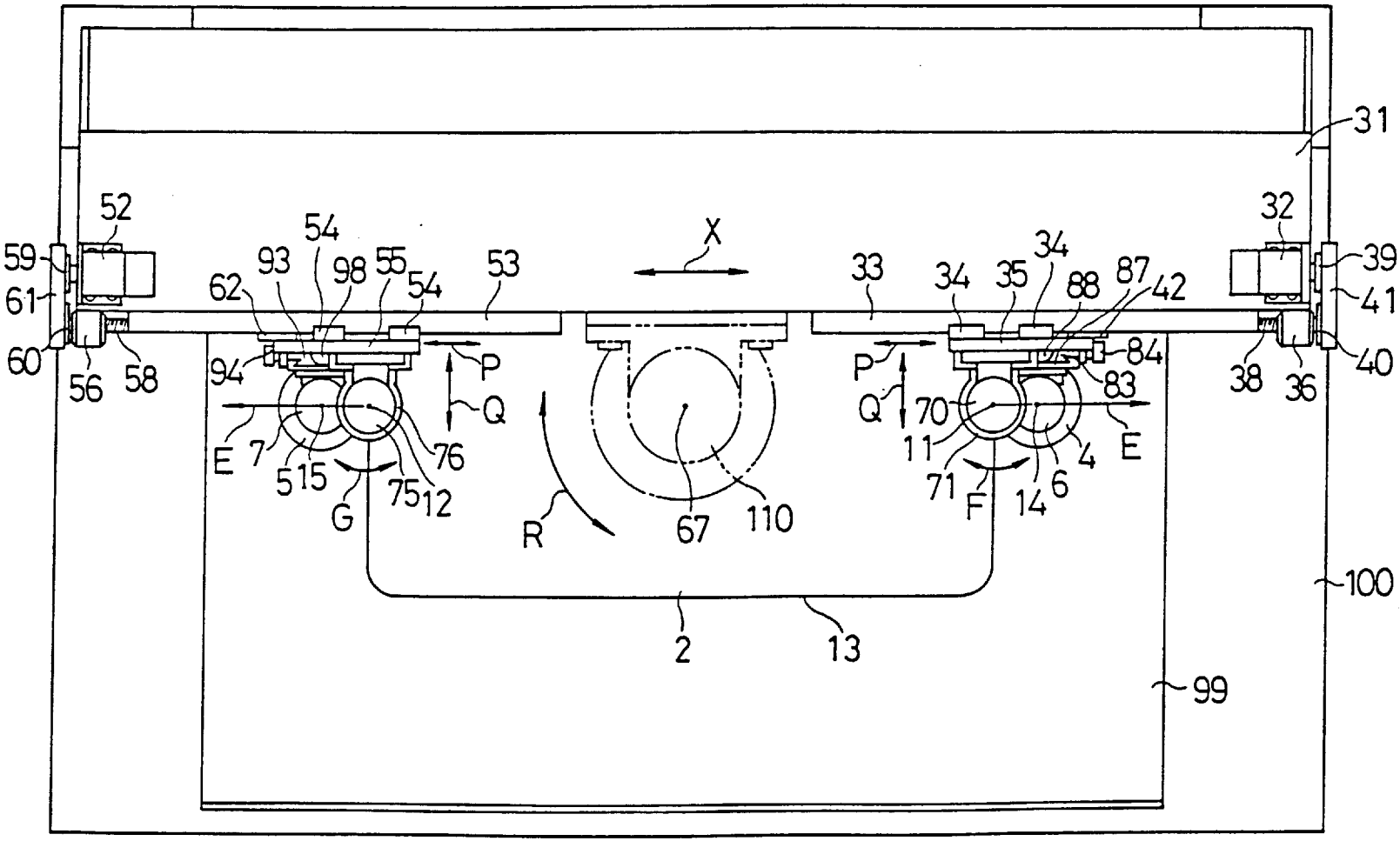
FIG. 5 is a plan view of the embodiment shown in FIG. 4.

In addition, in the glass-plate working machine 1 described above, the peripheral edge 13 of the glass plate 2 is subjected to edge grinding or chamfer grinding by one grinding wheel 4. However, as shown in FIGS. 4 and 5, an arrangement may be provided such that the peripheral edge 13 of the glass plate 2 is subjected to edge grinding or chamfer grinding by two wheels 4 and 5. Namely, a glass-plate working machine 150 shown in FIGS. 4 and 5 is further provided with a grinding wheel 5, an electric motor 7, a positioning device 9, and a revolving device 17 which respectively correspond to the grinding wheel 4, the electric motor 6, the positioning device 8, and the revolving device 16. The positioning device 9 is further provided with a linearly moving device 19 which corresponds to the linearly moving device 18.

In the positioning device 9 for relatively positioning a working portion D of the grinding wheel 5 with respect to a working point B on the glass plate 2, the linearly moving device 19 for moving the grinding wheel 5 in the direction X within the horizontal plane so as to position the working portion D of the grinding wheel 5 with respect to the working point B on the glass plate 2 concerning the direction X within the horizontal plane is formed in the same way as the linearly moving device 18. Namely, the linearly moving device 19 is comprised of an electric motor 52 mounted on the machine frame 31; a pair of rails 53 attached to the machine frame 31 in such a manner as to extend in the direction X and in parallel with each other; a movable base 55 attached to the rails 53 movably in the direction X by means of sliders 54; and a threaded shaft 58 supported rotatably by the machine frame 31 by means of bearings 56 and 57. A belt 61 is trained between a pulley 59 attached to an output rotating shaft of the motor 52 and a pulley 60 attached to one end of the threaded shaft 58, and the threaded shaft 58 is threadedly engaged with a nut 62 attached to the movable base 55. When the motor 52 is activated and its output rotating shaft is thereby rotated, its rotation is imparted to the threaded shaft 58 by means of the pulley 59, the belt 61, and the pulley 60, and the rotation of the threaded shaft 58 meshing with the nut 62 moves the movable base 55 in the direction X.

The revolving device 17 for revolving the grinding wheel 5 around an axis 12 perpendicular to the horizontal plane and passing through the working point B, so as to dispose the center 15 of rotation of the grinding wheel 5 in the direction E with respect to the contour 13 to which the glass plate 2 is to be machined at the working point B, is formed in the same way as the revolving device 16. Namely, the revolving device 17 comprises an electric motor 75 attached to the movable base 55, and a rotating shaft 77 connected to an output rotating shaft of the motor 75 and attached to the movable base 55 by means of a bearing 76 in such a manner as to be rotatable about the axis 12 in a direction G. When the motor 75 is activated and its output shaft is thereby rotated, the rotating shaft 77 is also rotated about the axis 12, thereby causing the grinding wheel 5 to be revolved about the shaft 12 in the direction G.

The glass-plate working machine 150 in accordance with this embodiment is provided with an adjustment mechanism 81 corresponding to the adjustment mechanism 80. The adjustment mechanism 81 is formed in the same way as the adjustment mechanism 80 and is comprised of a P-direction adjusting mechanism including a slider 93 attached to a slider 92 in such a manner as to be movable in the direction P relative to the slider 92, and an adjustment knob 94 for adjusting the P-direction position of the slider 93 with respect to the slider 92; a Q-direction adjusting mechanism including the slider 92 attached to a bracket 95 in such a manner as to be movable in the direction Q relative to the bracket 95 connected and secured to the rotating shaft 77, and an adjustment knob 96 for adjusting the Q-direction position of the slider 92 with respect to the bracket 95; and a Z-direction adjusting mechanism including a slider 97 with the motor 7 attached thereto, the slider 97 being attached to the slider 93 in such a manner as to be movable in the direction Z relative to the slider 93, and an adjustment knob 98 for adjusting the Z-direction position of the slider 97 with respect to the slider 93. As each of the knobs 94, 96, and 98 is rotated, it is possible to adjust the P-direction position of the slider 93 with respect to the slider 92, the Q-direction position of the slider 92 with respect to the bracket 95, and the Z-direction position of the slider 97 with respect to the slider 93, respectively.

The motors 6, 7, 32, 52, 65, 70, and 75 of the glass-plate working machine 150 thus arranged are operated by preprogrammed numerical control commands of an unillustrated numerical control unit in the same way as described above. Here, the motors 6, 7, 32, 52, 65, 70, and 75 may be controlled such that the grinding wheel 4 chamfers a half area with respect to the peripheral edges 13, while the grinding wheel 5 chamfers the remaining half area with respect to the peripheral edges 13, or such that the grinding wheel 5 is replaced by a polishing wheel, and the grinding wheel 4 rough grinds the peripheral edges 13, while the polishing wheel 5 polishes the peripheral edges 13 rough ground by the grinding wheel 4.

In addition, although in the above-described embodiment two sets of grinding wheels 4 and 5 and the like are arranged symmetrically about the axis 67, the glass-plate working machine in accordance with the present invention may be constructed by additionally arranging more sets of grinding wheels and the like symmetrically about the axis 67. If a plurality of working tools are thus provided, it is possible to reduce the machining operation time.

I claim:

1. A glass-plate working machine comprising:

a table on which a glass plate to be worked is placed;

a working tool for working the glass plate placed on said table;

a driving device for driving said working tool;

a moving device for relatively moving a working portion of said working tool with respect to a working point on the glass plate;

a fixing device for fixing the glass plate onto said table; and a revolving device for revolving said working tool around an axis perpendicular to a plane and passing through the working point, said plane being parallel with a surface of the glass plate;

wherein said moving device includes a linearly moving device for moving said working tool in a linear direction so as to position the working portion of said working tool with respect to the working point on the glass plate in a linear direction within the plane, said linearly moving device being provided on a frame, which extends in a direction parallel with said linear direction, both ends of which are firmly fixed, respectively, and a rotating device for rotating the glass plate so as to position the working point on the glass plate with respect to the working portion of said working tool in a direction of rotation within the plane, said direction in which said frame extends being parallel with a line which connects said axis with a center of rotation of the glass plate in the said plane; and a preprogrammed numerical control unit for controlling the operation of said moving device and said revolving device, whereby said revolving device is controlled so that no more than a revolution of said working tool around said axis of 180E is effected for working the glass plate, said working tool comprising a grinding wheel, and said revolving device being controlled so as to dispose a center of rotation of said grinding wheel in a direction normal to a contour to which said glass plate is to be machined at the working point.

2. A glass-plate working machine according to claim 1, wherein said fixing device includes a pressing device for pressing and clamping the glass plate in cooperation with said table.

3. A glass-plate working machine comprising:

a table on which one glass plate to be worked is placed;

a plurality of working tools for working the glass plate placed on said table, at different positions around said table;

a driving device for driving said working tools;

a moving device for relatively moving working portions of said working table with respect to working points on the glass plate independently of each other;

a fixing device for fixing the glass plate onto said table;

a plurality of revolving devices for revolving said working tools independently of each other, around axes perpendicular to a plane and passing through the working points, said plane being parallel with a surface of the glass plate;

wherein said moving device includes a plurality of linearly moving devices for moving said working tools in linear directions independently of each other so as to position the working portions of said working tools with respect to the working points on the glass plate in the linear directions within the plane, said plurality of linearly moving devices being provided on a frame, which extends in a direction parallel with said liner direction, both ends of which are firmly fixed, respectively, and a rotating device for rotating the glass plate so as to position the working points on the glass plate with respect to the working portions of said working tools in a direction of rotation within the plane, said direction in which said frame extends being parallel with a line which connects said axis with a center of rotation of the glass plate in the said plane; and a preprogrammed numerical control unit for controlling the operation of said moving device and said revolving device, said revolving device being controlled in operation so that no more than a revolution of the corresponding working tool around said axis of 180E is effected for working the glass plate;

said working tools comprising grinding wheels, each said revolving device being controlled so as to dispose the center of rotation of said corresponding grinding wheel in a direction normal to a contour to which said glass plate is to be machined at the working point.

4. A glass-plate working machine according to claim 3, wherein said fixing device includes a pressing device for pressing and clamping the glass plate in cooperation with said table.

5. A glass-plate working machine comprising:

a table on which a glass plate to be worked is placed;

a working tool for working the glass plate placed on said table;

a driving device for driving said working tool;

a moving device for relatively moving a working portion of said working tool with respect to a working point on the glass plate;

a fixing device for fixing the glass plate onto said table;

a revolving device for revolving said working tool around an axis perpendicular to a plane and passing through the working point, said plane being parallel with a surface of the glass plate, said revolving device comprising an electric motor having an output rotating shaft, which is rotated around the axis, said output rotating shaft of the electric motor being connected to said driving device, which is attached with the working tool, whereby said working tool is revolved around the identical axis with the rotation axis of said output rotating shaft of the electric motor;

wherein said moving device includes a linearly moving device for moving said working tool in a linear direction so as to position the working portion of said working tool with respect to the working point on the glass plate in a linear direction within the plane, said linearly moving device being provided on a frame, which extends in a direction parallel with said linear direction, both ends of which are firmly fixed, respectively, and a rotating device for rotating the glass plate so as to position the working point on the glass plate with respect to the working portion of said working tool in a direction of rotation within the plane, said directions in which said frame extends being parallel with a line which connects said axis with a center of rotation of the glass plate in the said plane; and a preprogrammed numeral control unit for controlling the operation of said moving device and said revolving device, whereby said revolving device is controlled so that no more than a revolution of said working tool around said axis of 180E is effected for working the glass plate;

said working tool comprising a grinding wheel, and said revolving device being controlled so as to dispose a center of rotation of said grinding wheel in a direction normal to a contour to which said glass plate is to be machined at the working point.

6. A glass-plate working machine according to claim 5, wherein said fixing device includes a pressing device for pressing and clamping the glass plate in cooperation with said table.

7. A glass-plate working machine comprising:

a table on which a glass plate to be worked is placed;

a plurality of working tools for working the glass plate placed on said table, at different positions around said table;

a plurality of driving devices for driving said working tools;

a moving device for relatively moving working portions of said working table with respect to working points on the glass plate independently of one another;

a fixing device for fixing the glass plate onto said table; and a plurality of revolving devices for revolving said working tools independent of each other, around axes perpendicular to a plane and passing through the working points, said plane being parallel with a surface of the glass plate, said revolving device comprising an electric motor having an output rotating shaft, which is rotated around the corresponding axis, said output rotating shaft of the electric motor being connected to the corresponding driving device, which is attached with the corresponding working tool, whereby the corresponding working tool is revolved around the corresponding identical axis with the rotation axis of said output rotating shaft of the electric motor;

wherein said moving device includes a plurality of linearly moving devices for moving said working tools in linear directions independently of each other so as to position the working portions of said working tools with respect to the working points on the glass plate in the linear directions within the plane, said plurality of linearly moving devices being provided on a frame, which extends in a direction parallel with said linear direction, both ends of which are firmly fixed, respectively, and a rotating device for rotating the glass plate so as to position the working points on the glass plate with respect to the working positions of working tools in a direction of rotation within the plane, said direction in which said frame extends being parallel with a line which connects said axis with a center of rotation of the glass plate in the said plane; and a preprogrammed numerical control unit for controlling the operation of said moving device and said revolving device, whereby said revolving device is controlled so that no more than a revolution of the corresponding working tool around said axis of 180E is effected for working the glass plate;

said working tools comprising grinding wheels, each said revolving device being controlled so as to dispose a center of rotation of said corresponding grinding wheel in a direction normal to a contour to which said glass plate is to be machined at the working point.

8. A glass-plate working machine according to claim 7, wherein said fixing device includes a pressing device for pressing and clamping the glass plate in cooperation with said table.

* * * * *

UNITED STATES PATENT AND TRADEMARK OFFICE

CERTIFICATE OF CORRECTION

PATENT NO. : 5,807,166
DATED : September 15, 1998
INVENTOR(S) : BANDO

It is certified that error appears in the above-identified patent and that said letters patent is hereby corrected as shown below:

On title page,

Item [56], under "Foreign Patent Documents," insert --63-84861 4/1988 Japan-- after recitation of Japanese Reference No. 60-12187.

Column 9, line 3, change "180E" to --180°--;

line 20, change "table" to --tools--;

line 35, change "liner" to --linear--;

line 48, change "180E" to --180°--.

Column 10, line 33, change "180E" to --180°--;

line 52, change "table" to --tools--.

Column 12, line 5, change "180E" to --180°--.

Signed and Sealed this

Seventh Day of September, 1999

*Attest:*

Q. TODD DICKINSON

*Attesting Officer*

*Acting Commissioner of Patents and Trademarks*